US006490745B1

(12) United States Patent
Kim

(10) Patent No.: US 6,490,745 B1
(45) Date of Patent: Dec. 10, 2002

(54) CONTINUOUS COMPOSITE STEEL GIRDER BRIDGE CONSTRUCTED BY APPLYING A TEMPERATURE GRADIENT AND METHOD FOR CONSTRUCTING THE SAME

(76) Inventor: Sang-Hyo Kim, #1-902 Daerim Apt., Yeonhee 3-dong, Seodaemun-ku, Seoul 120-113 (KR)

( * ) Notice: Subject to any disclaimer, the term of this patent is extended or adjusted under 35 U.S.C. 154(b) by 0 days.

(21) Appl. No.: 09/720,120

(22) PCT Filed: Aug. 4, 1999

(86) PCT No.: PCT/KR99/00431

§ 371 (c)(1),
(2), (4) Date: Dec. 21, 2000

(87) PCT Pub. No.: WO00/08257

PCT Pub. Date: Feb. 17, 2000

(30) Foreign Application Priority Data

Aug. 5, 1998 (KR) ..... 98-31920

(51) Int. Cl.[7] ..... E01D 21/00; F24H 3/00
(52) U.S. Cl. ..... 14/77.1; 165/47
(58) Field of Search ..... 14/74.5, 77.1; 165/47, 48, 138; 52/745.19

(56) References Cited

U.S. PATENT DOCUMENTS 4,007,574 A * 2/1977 Riddell ..... 52/220.2
4,019,581 A * 4/1977 Diggs ..... 169/16
4,343,432 A 8/1982 Belengeuer
4,630,798 A * 12/1986 Muller ..... 14/23
4,880,051 A * 11/1989 Ohashi ..... 165/45
5,617,599 A * 4/1997 Smith ..... 14/73
5,743,326 A * 4/1998 Slocum ..... 165/47

FOREIGN PATENT DOCUMENTS

| | | | |
|---|---|---|---|
| EP | 0021823 | | 1/1981 |
| GB | 2 268 946 A | * | 1/1994 |
| JP | 9-100513 | | 4/1997 |

OTHER PUBLICATIONS

Article by Kim et al., published Mar. 2001, entitled "A Study on Thermal Behavior of Continuous Composite Girder Bridges in Thermal Prestressing Method", Korean Civil Engineering Publications, vol. 21–2A, pp. 207–216, with English Language Abstract.
English Language Abstract of JP–100513.

* cited by examiner

*Primary Examiner*—Gary S. Hartmann
(74) *Attorney, Agent, or Firm*—Greenblum & Bernstein, P.L.C.

(57) ABSTRACT

The present invention is to provide a continuous composite steel girder bridge using an apparatus to provide a temperature gradient to the steel girder (2) by circulation hot water. The apparatus is comprised of: a hot water circulation pipe (11) attached to steel girder (2) for providing hot water circulation before the composition of the steel girder (2) and the concrete slab (1) starts and until such a composition is completed; a temperature control sensor (12), attached to the steel girder (2) for sensing the temperature of the steel girder (2); and a controller (13) for controlling the temperature of the steel girder (2) to retain a predetermined temperature gradient while the composition effect takes place.

13 Claims, 9 Drawing Sheets

TEMPERATURE (°C)

TEMPERATURE (°C)

TEMPERATURE (°C)

TEMPERATURE (°C)

CONTINUOUS COMPOSITE STEEL GIRDER BRIDGE CONSTRUCTED BY APPLYING A TEMPERATURE GRADIENT AND METHOD FOR CONSTRUCTING THE SAME

TECHNICAL FIELD

The present invention relates to a continuous steel girder bridge applying a temperature gradient to improve the bridge behavior due to the (–)bending moment acting near the inner supports of continuous steel girder bridges. More particularly, it relates to the continuous steel girder bridge constructed by temporarily applying an artificial temperature gradient to the steel girder of the composite girder bridge from shortly before the slab concrete is casted and until full composition effect between the girder and slab takes place. By removing the artificial temperature gradient after composition is completed, prestressing effects like the followings are acquired; cracks can be prevented by offsetting the tensile stress acting on concrete slab resulted from the (–) moment, reducing the amount of the slab reinforcement bar and decreasing the cross-section of steel girder are also possible.

BACKGROUND OF THE INVENTION

Hereafter, the composite bridge of prior art will be schematically described, referring to FIGS. 1A, 1B, 2A and 2B.

Referring to FIG. 1, the composite steel bridge of prior art is comprised of reinforced concrete slab 1, a steel girder 2 supporting the slab 1 and shear connectors 3 disposed over all length of the steel girder 2 to combine the steel girder 2 with the slab 1. Above components operate as a composite section. In this case, stresses of steel girder and concrete slab under design loadings have to be restricted under the allowable stresses. There is no particular problem in the case of a simply supported beam, but in the case of a multispan beam, the (–) bending moments develop near the inner supports due to the live load as well as dead load and cause tensile stresses in the concrete slab and upper section of the steel girder. To prevent the tensile stresses from developing in the concrete slab, it is necessary to arrange the longitudinal reinforcing bars or to adopt up and down construction method or prestressing method using prestressing tendon. All of these traditional techniques make construction process complicated.

FIGS. 2A and 2B show the typical bending moment diagrams of general 2-span continuous bridge and 3-span continuous bridge, respectively. The tensile stress occurs in the concrete slab under the (–) bending moment, causing tensile cracks. In the design and construction of composite bridges, additional reinforcements in the longitudinal direction are placed to resist the tensile stresses acting on concrete slab. However, the tensile cracks of the concrete slab can not be prevented. Sometimes in designing this kind of continuous composite bridge, sections under the (+) bending moment are assumed to be composed and sections under the (–) bending moment are assumed to be non-composed. However, the tensile stresses still develop due to partial composite action between the slab and girders.

According to the previous studies, by placing reinforcement bars in the longitudinal direction by more than 2% of the concrete slab section area, and by keeping the ratio of the total circumference of the reinforcement bar to the cross-section of the concrete slab above 0.045 cm/cm$^2$, the tensile crack of the concrete slab can be limited to allowable crack width. Also the longitudinal reinforcement bars have to be extended up to the compressive stress region.

Therefore, in practice, the longitudinal reinforcing bars are excessively arranged in the (–) moment region, thereby increasing the amount of steel needed and decreasing the workability at site.

DISCLOSURE OF INVENTION

It is, therefore, an object of the present invention to provide continuous Composite steel girder bridge using temporary temperature gradient to generate compressive stress in the concrete slab near the inner supports, offsetting the tensile stress due to the (–) bending moment caused by the live and dead load, and thereby preventing the tensile cracks.

Further, another object of the present invention is provide continuous Composite steel girder bridge and method for constructing the same capable of decreasing the amount of longitudinal reinforcing bars needed to limit the tensile crack size, and reducing the cross section of the steel girder by applying a temporary temperature gradient to the steel girder before the composite effect takes place.

Furthermore, the other object of the present invention is to provide a method of constructing continuous composite bridge applying an artificial temperature gradient with simple equipments.

In order to accomplish the objects mentioned above, the continuous composite girder bridge constructing method using temperature gradient comprises: a first step of placing a continuous steel girders over predetermined spans; a second step of providing heating source over the upper and lower parts of said steel girder to generate a desired temperature gradient; a third step of composing after casting and curing the concrete slab on the continuous steel girder having the desired temperature gradient; and a fourth step of offsetting the tensile stress in the concrete slab occurring due to the dead load and live load, through the compressive stress simultaneously occurring in the upper section of the steel girder and the concrete slab, by removing the temperature gradient after said third step is completed.

Further, the apparatus which generates the temperature gradient is placed on the steel girder. It is comprised of the heat source, thermo-sensor that output the temperature of the heat source and a system controller to keep the artificial temperature gradient steady, based on the information collected from the thermo-sensor, until composition effect takes place.

Furthermore, the present invention presents a continuous composite bridge constructed using temporary temperature gradient yielding the compressive stresses in the concrete slab which offsets the tensile stress caused by the dead and live load.

BRIEF DESCRIPTION OF THE DRAWINGS

The advantage of the present invention will become apparent from the following description of the embodiment with reference to the accompanying drawings, in which.

BEST MODE FOR CARRYING OUT THE INVENTION

Figure 1A:
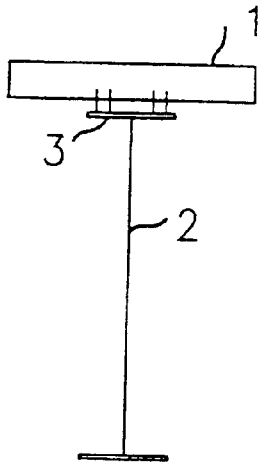
FIG. 1A (PRIOR ART)
FIGS. 1A and 1B show the schematic sections of the conventional composite steel girder bridges.
Figure 1B:
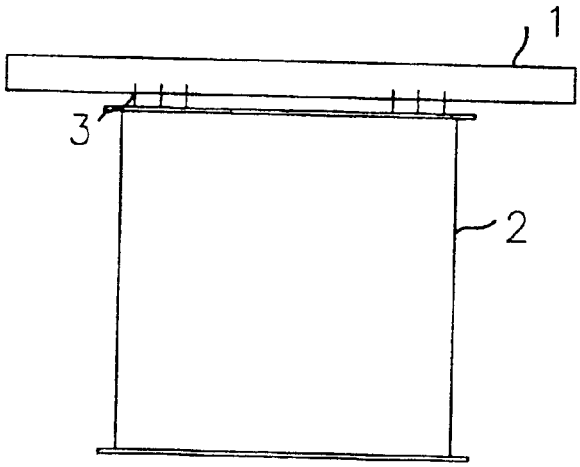
FIG. 1B (PRIOR ART)
Figure 2A:
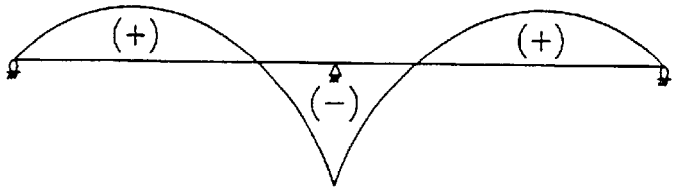
FIG. 2A (PRIOR ART)
FIGS. 2A and 2B are view illustrating moment of the general continuous girder bridge.
Figure 2B:
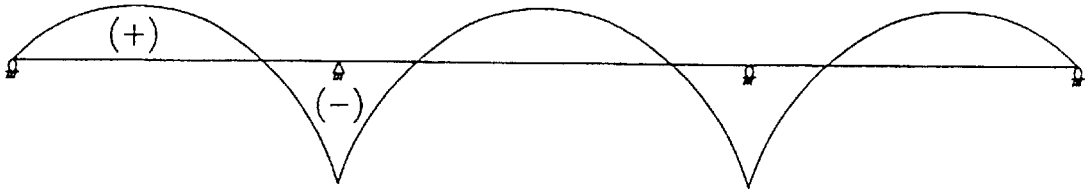
FIG. 2B (PRIOR ART)

Hereafter, embodiments of the present invention will be described in detail with reference to the accompanying drawings.

In accordance with the present invention, the continuous Composite steel girder bridge constructed using a temperature gradient and method for its construction are focused on applying an artificial temporary temperature gradient to the steel girder to offset the tensile stress, which occurs in the concrete slab near the inner supports. The continuous composite bridge can be constructed through a technique of applying an artificial temperature gradient during the construction period and then removing the temperature gradient after the composite effect is achieved. This construction method yields compressive stress offsetting the tensile stress, which occurs in the concrete slab near the inner supports due to the dead load and live load, and therefore, the stress in the concrete slab can be adjusted to be into compressive stress or under tensile stress lower than allowable tensile stress.

That is, in accordance with the present invention, the cracks caused by the (−) moment acting on concrete slab near the inner supports can be prevented without placing of additional reinforcing bars by the use of artificial temperature gradient which develops compressive stress in the concrete slab near the inner supports.

As mentioned above, the continuous composite bridge, which is comprised of the concrete slab and the steel girder, is constructed by applying an artificial temporary temperature gradient to the steel girder before composition of the girder and slab takes place, and by removing the said temperature gradient after the composition is completed, which yields compressive stress in the said concrete slab offsetting the tensile stress in said concrete slab due to (−) the moment neat the inner supports.

As mentioned above, the compressive stress is introduced in the concrete slab by applying the temperature gradient before and after the composition. This compressive stress offsets the tensile stress due to the dead load and live load and thus keeps the concrete slab under the state of compression preventing tensile cracks from forming. Also, because the said concrete slab is under either compression or tension with stress lower than allowable tensile stress, said concrete slab near the inner supports can be considered as effective area and thus the rigidity of the composite cross-section is increased.

The temperature gradient, which is applied to the steel girder before the composition with the concrete slab has the distribution like the following. The upper part of the steel girder has temperature near the atmosphere temperature, and the temperature reaches its peak at the bottom flange. The temperature gradient and the resulting stress distribution are shown in FIG. 3.

This embodiment of the present invention exemplified that the steel girder has a temperature gradient, which is controlled within the range of 10°~100°. The temperature gradient shown in FIG. 3 shows only the difference between the upper and lower parts of the steel girder.

Figure 3:
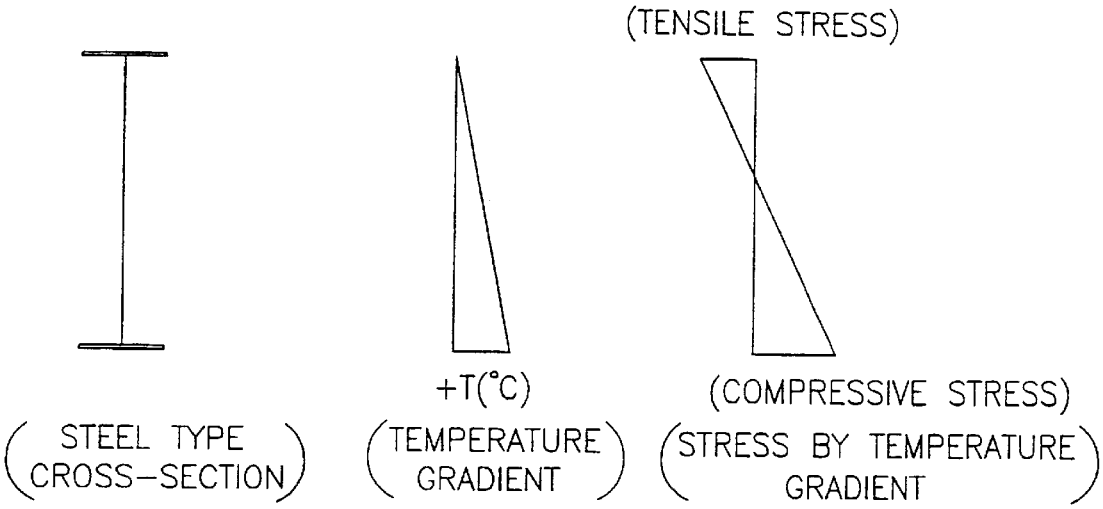
FIG. 3 shows diagrams of the artificial temperature gradients introduced to the across-section before the composition of a continuous Composite steel girder bridge, and the stress distribution diagram corresponding to the temperature gradient of the present invention.
Figure 4:
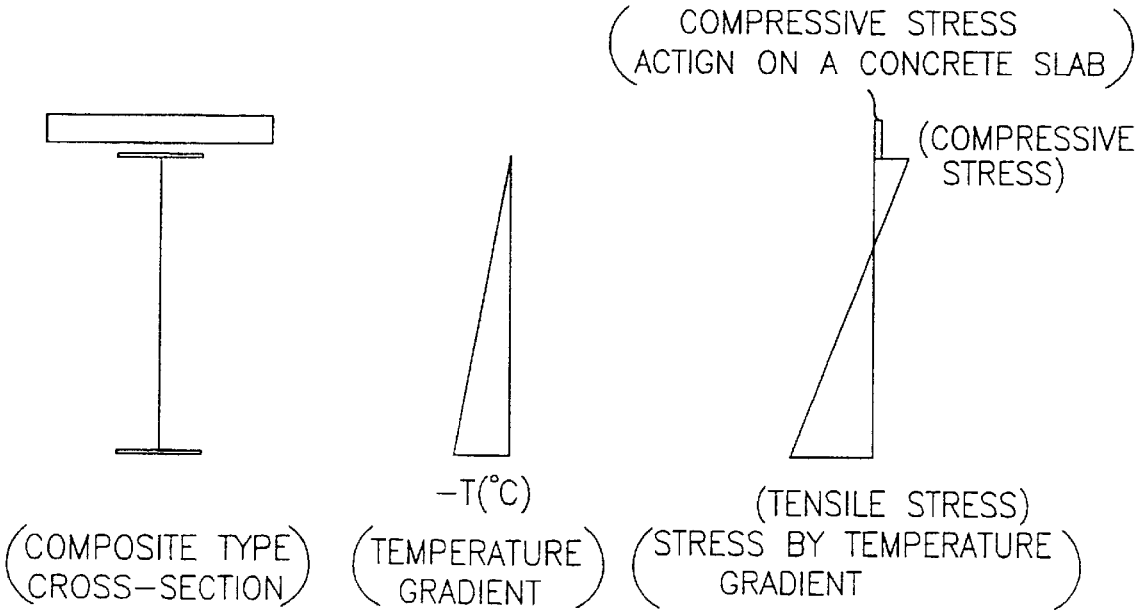
FIG. 4 shows a diagram of the temperature gradient of the cross-section, occurring by removing the temperature gradient after the composition, and the stress distribution diagram corresponding to the temperature gradient of the present invention.

Also, as shown in FIG. 4, after the concrete slab has cured, the temperature gradient is removed, thereby having an effect of applying the opposite temperature gradient of FIG. 3.

Figure 5:
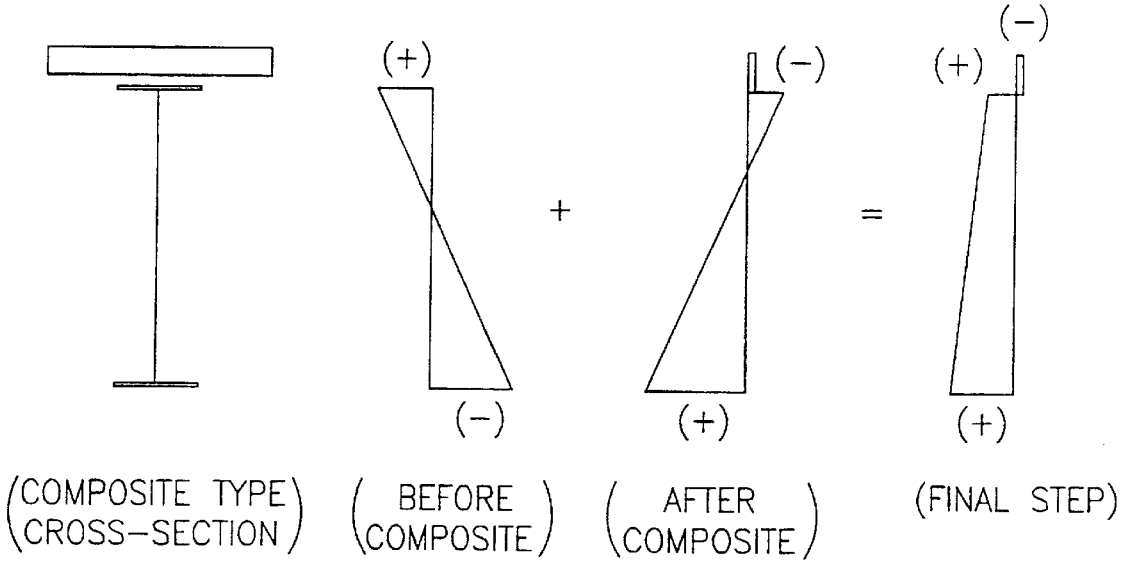
FIG. 5 shows diagrams of stress distribution in a cross-section of steps before and after the composition of a continuous composite girder bridge respectively.

As shown in FIG. 5, the diagram shows the stress distributions of the composite type cross-sections in each step. The tensile stress is distributed in the lower part of the steel girder and the compressive stress is distributed in the concrete slab like shown in the figure of the final stress state. Therefore, the cracks due to the tensile stress to be distributed near the inner supports in the concrete slab, which is constructed via the traditional process without the artificial temperature gradient technique, can be prevented. On the contrary, because the tensile stress distributed in the lower flange of the steel girder by the temperature gradient can offset the compressive stress due to the service load, the cross-section of the steel girder can be reduced.

Figure 6A:
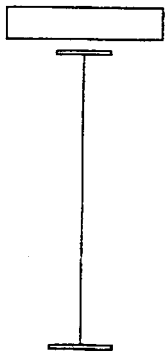
FIGS. 6A to 6E are illustrative diagrams of the cross-sections of composite bridges to which the design and construction method of present invention can be applied.
Figure 6B:
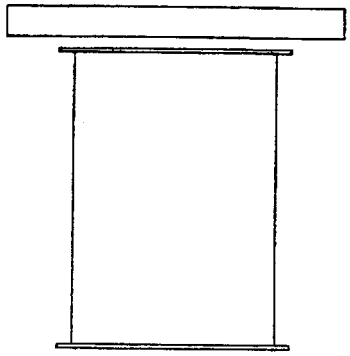
Figure 6C:
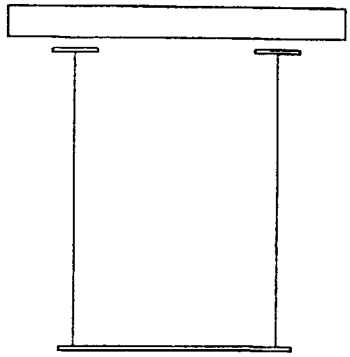
Figure 6D:
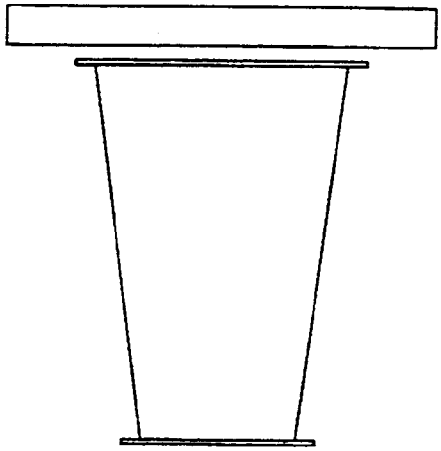
Figure 6E:
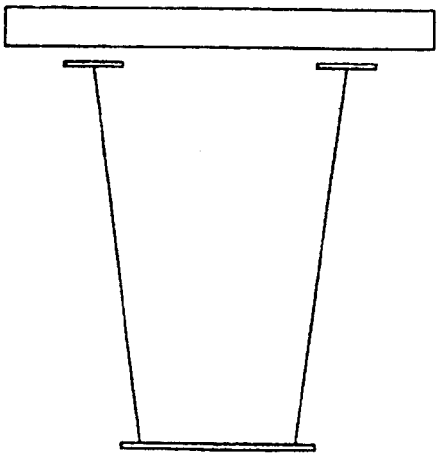
Figure 7A:
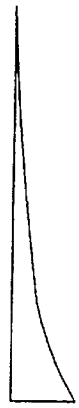
FIGS. 7A to 7D are illustrative diagrams of the forms of temperature gradient that can be applied to the cross-sections of the composite bridges according to the present invention.
Figure 7B:
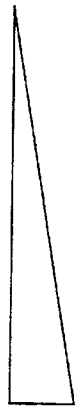
Figure 7C:
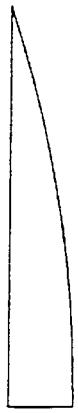
Figure 7D:
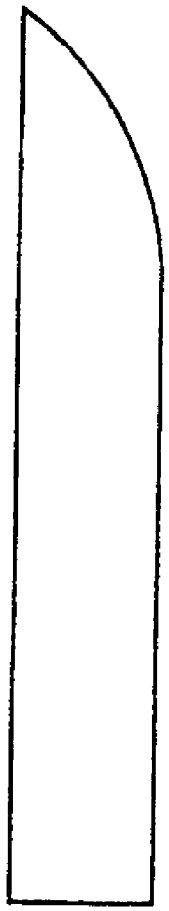

This embodiment is illustrated in regard to an I-type steel plate girder bridges as shown in FIG. 6A, but it is not limited to the particular embodiment. As shown in FIGS. 6A to 6E, the embodiment of the present invention may be applied to steel plate girders, steel box girders, U-type steel box girders, trapezoid steel box girders, trapezoid U-type steel box girders and so on. And a plurality of these composite type cross-sections can be arranged in row to form a cross-section of a bridge. If necessary, the cross-sections of the composite bridges, shown in FIGS. 6A to 6E may have the various types of the temperature gradients as shown in FIGS. 7A to 7D.

Figure 8:
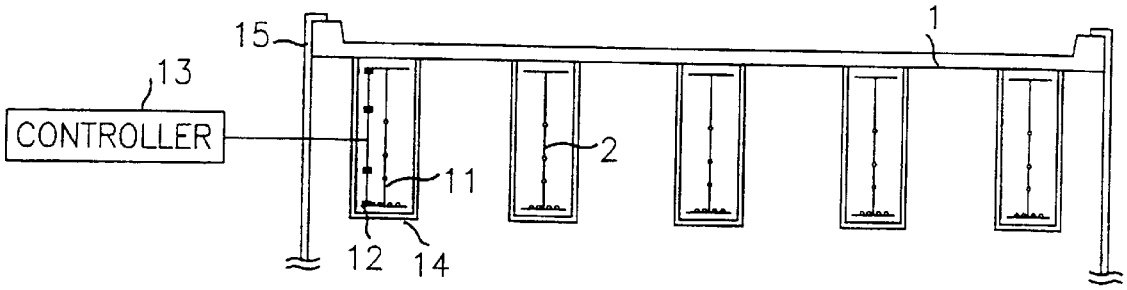
FIG. 8 is a schematic diagram of an apparatus for applying the temperature gradient according to the embodiment of the present invention.
Figure 9:
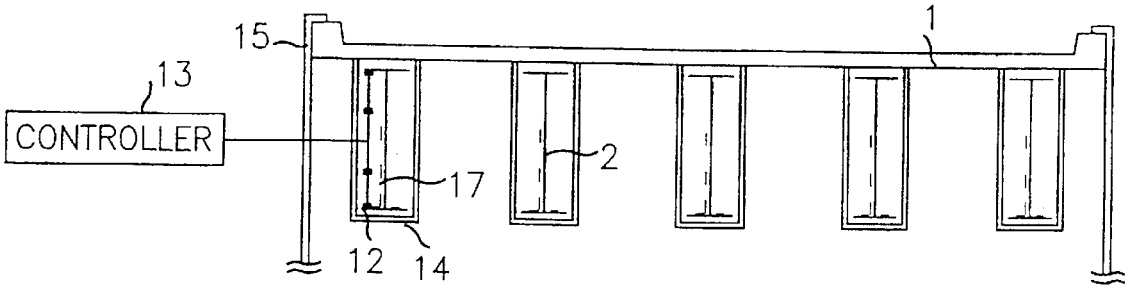
FIG. 9 is a schematic diagram of an apparatus for applying the temperature gradient according to another embodiment of the present invention.

On the other hand, FIG. 8 and FIG. 9 show an apparatus for generating the temperature gradient in the continuous composite bridge of the present invention during the construction stage of the bridge.

FIG. 8 shows the apparatus to provide the temperature gradient to the steel girder by circulating hot water. As shown in FIG. 8, the apparatus is comprised of a hot water circulation pipe 11 attached to steel girder 2 for providing hot water circulation from before and until composition with concrete slab 1; a temperature sensor 12 attached to the steel girder 2 for sensing the temperature of the steel girder 2; and a controller 13 for controlling the temperature of the steel girder 2 to retain the predetermined temperature gradient from before and until the composition effect takes place.

The hot water circulation pipe 11 is arranged densely on the lower part and sparsely toward the upper part. Also, if necessary, an insulation 14 may be provided around the steel girder 2 so that the steel girder 2 can not be influenced by an external air temperature.

Also if necessary, a sunshade membrane 15 may be provided to prevent the solar radiation, which disturbs the artificial temperature gradient distribution.

FIG. 9 shows the apparatus to provide the temperature gradient to the steel girder by a heating plate 17. The sunshade membrane 15 may be placed for the exterior steel girders 2, the heating plate 17 is used as a heating source. The rest components of the FIG. 9 are the same as shown in FIG. 8.

As mentioned above, the temperature gradient is applied to the steel girder by using the predetermined heating source, then the compressive stress is generated in the concrete slab near the inner supports. The method for construction of the continuous Composite steel girder bridge according to the present invention will be explained hereinafter.

First, the continuous steel girder 2 is placed, a shear connector is attached over the whole length of the steel girder 2 to compose with the concrete slab 1.

Next, according to the shape of the temperature gradient required, heating source such as the pipe line 11, the heating plate 17 and so on is attached to the continuous steel girder 2 providing heat to keep the required temperature distribution as shown in FIG. 3. The temperature gradient is provided to the steel girder 2 by means of the temperature sensor 12 and controller 13 controlling the temperature of the heat source. Various shapes of the temperature gradient shown in FIGS. 7A to 7D can be obtained. According to the arrangement of the circulation pipe 11 or the heating plate 17, which is attached to the steel girder. That is, the temperature gradient shown in FIG. 7A can be obtained by placing the hot water circulation pipe 11 or the heating plate 17 densely only on the lower flange. The temperature gradient shown in FIG. 7B can be obtained by enlarging gradually the distance of the heat source on the web toward the upper flange. In the same way, the temperature gradients shown in FIGS. 7C and 7D can be obtained by controlling the distance between the circulation pipes 11 or the heating plates 17.

And, according to the compressive stress needed to offset the tensile stress, the heating source is provided to retain the temperature difference between the lower and the upper parts of the steel girder within 10° C.~100° C. The temperature of the heating source is determined by atmosphere temperature at the construction site. For example, if the temperature gradient is set to 50° C. and the temperature of the upper part of the steel girder 2 is 20° C., the temperature of the lower part of the steel girder 2 will be set to 70° C. Through the curing of the concrete slab, the set temperature should be changed properly depending on the temperature change of the upper part of the steel girder 2, so the temperature gradient can be retained by the use of the temperature sensor 12 and the controller 13.

After applying the temperature distribution to the continuous steel girder and curing the concrete slab as mentioned above, the steel girder and the concrete slab are composed by the shear connector.

Next, if the heating source, which was provided to the steel girder, is removed after the concrete slab is composed with the steel girder, the temperature gradient acts in a reverse manner on the composite cross-section. Then, the compressive stress will be distributed at the upper part of the steel girder and the concrete slab by the effect of the temperature gradient. This compressive stress will offset the tensile stress in the concrete slab due to the (–) moment near the inner supports.

The proper time for removing the heating source should be when the required strength of concrete can be obtained.

As mentioned above, the cracks of the concrete slab can be prevented by retaining the concrete slab near the inner supports of the continuous composite bridge in the state of compressive stress (or under allowable tensile stress).

As mentioned above, according to the present invention, the artificial temperature gradient is provided to the steel girder before the steel girder and the concrete slab are composed in the continuous composite bridge, and then the artificial temperature gradient is removed after the composition is completed. As a result, the tensile crack is prevented by offsetting the tensile stress, which is caused by the dead and live load, in the concrete slab near the inner supports keeping the stress of the concrete slab into compressive stress or under tensile stress lower than allowable tensile stress the compressive stress. The lower flange of the steel girder experiences tensile stress, which offsets the compressive stress due to the service load, consequently, the cross-section of the steel girder can be reduced. Also, the tensile stress of the concrete slab near the inner supports is offsetted by the compressive stress, which is made through the temperature gradient technique. Therefore additional reinforcing bars in the longitudinal direction are not required at the region near the inner supports and only the distribution bars are needed, thereby allowing the amount of reinforcing bars to be reduced and the construction procedure to be simplified.

Such changes and modifications are to be understood as being within the scope of the present invention as defined by the appended claims.

What is claimed is:

1. A method for constructing a continuous composite steel girder bridge, comprising:

placing a continuous steel girder over predetermined spans;

providing a heating source over the upper and lower parts of said steel girder in order to provide an artificial temperature gradient along the steel girder;

casting and curing a concrete slab and composing the concrete slab on said continuous steel girder having said temperature gradient; and offsetting tensile stress in the concrete slab due to dead and live load, through the compressive stress occurring on the upper part of said steel girder and said concrete slab, by removing the artificial temperature gradient after said composing is completed.

2. The method according to claim 1, wherein a steel girder cross-section is one of a steel plate girder, steel box girder, U-type steel box girder, trapezoid steel box girder, and trapezoid U-type steel box girder.

3. The method according to claim 1, further comprising establishing, by the heating source, a maximum temperature at the lower part of said steel girder and said temperature is lowered toward the upper part of said steel girder, thereby allowing the predetermined temperature gradient to be formed.

4. The method according to claim 3, wherein the temperature of the upper part of said steel girder is set equal to the temperature of said steel girder under condition that heat is not provided from the heating source.

5. The method according to claim 1, wherein the temperature gradient to be applied to the steel girder is determined within the range of 10° C.–100° C.

6. The method according to claim 1, further comprising removing the heating source when the required concrete strength is acquired after said concrete slab is cured.

7. A continuous composite steel bridge constructed by the method of claim 1.

8. An apparatus for generating a temperature gradient of a steel girder for a continuous composite steel bridge comprising:

a heating source attached to said steel girder for providing an artificial temperature gradient from before the composition of said steel girder and said concrete slab and until composition is completed;

a temperature sensor attached to said steel girder for sensing the temperature of the steel girder; and a controller for controlling the temperature of the steel girder to retain the predetermined artificial temperature gradient from before said steel girder and said concrete slab are composed to after said steel girder and said concrete slab are composed.

9. The apparatus according to claim 8, wherein said heating source is in a form of a heating plate, and a heating point is established on at least one point of the steel girder, a distribution of said heating points is more dense at the lower part of the steel girder than at the upper part, and the distance between said heating points is wider toward the upper part of the girder than at the lower part of the girder.

10. The apparatus according to claim 8, further comprising a thermal insulator around the steel girder so that the temperature provided from said heating source is not influenced by environmental factors.

11. The apparatus according to claim 8, further comprising a sunshade membrane, which is placed along the exterior girder of a bridge, preventing a difference in temperature distribution between said interior steel girder and said exterior girder due to solar radiation.

12. The apparatus according to claim 8, wherein said heating source is in a form of a hot water circulation pipe, and a heating point is established on at least one point of the steel girder, a distribution of said heating points is more dense at a lower part of the steel girder than at an upper part, and the distance between said heating points is wider toward the upper part of the girder than at the lower part of the girder.

13. A method of constructing a continuous composite steel bridge by composing a concrete slab with a continuous steel girder supporting said concrete slab, wherein an artificial temporary temperature gradient is introduced within the steel girder before the composition of said concrete slab and steel girder, and the temperature gradient is removed after the composition is completed, thereby allowing the compressive stress in said concrete slab generated by said temperature gradient to offset the tensile stress in a portion of said concrete slab under (–) bending moment.

* * * * *